US009575466B1

(12) United States Patent
Thompson et al.

(10) Patent No.: US 9,575,466 B1
(45) Date of Patent: Feb. 21, 2017

(54) SENSOR-ENABLED FASHION TIMEPIECE

(71) Applicant: Fossil Group, Inc., Richardson, TX (US)

(72) Inventors: Philip Brodie Crosley Thompson, Plano, TX (US); Gregory Alan McKelvey, Dallas, TX (US); Brandon D. Little, Dallas, TX (US); Diarmuid John St. Cullum Bland, Basel (CH); Brad William Piercey, Garland, TX (US)

(73) Assignee: Fossil Group, Inc., Richardson, TX (US)

( * ) Notice: Subject to any disclaimer, the term of this patent is extended or adjusted under 35 U.S.C. 154(b) by 0 days.

(21) Appl. No.: 14/946,639

(22) Filed: Nov. 19, 2015

Related U.S. Application Data

(62) Division of application No. 14/476,415, filed on Sep. 3, 2014, now abandoned.

(51) Int. Cl.

| | |
|---|---|
| ***G04B 47/06*** | (2006.01) |
| ***G04C 3/00*** | (2006.01) |
| ***G04C 10/00*** | (2006.01) |
| ***G04G 21/02*** | (2010.01) |

(52) U.S. Cl.
CPC ..... *G04B 47/06* (2013.01); *G04B 47/063* (2013.01); *G04C 3/008* (2013.01); *G04C 10/00* (2013.01); *G04G 21/02* (2013.01); *G04G 21/025* (2013.01)

(58) Field of Classification Search
CPC ..... G04B 47/06; G04B 47/063; G04B 47/066; G04B 47/068; G04B 37/007; A61B 5/1118; G04C 3/008; G04C 10/00; G04G 21/02; G04G 21/025
See application file for complete search history.

(56) References Cited

U.S. PATENT DOCUMENTS

| | | | |
|---|---|---|---|
| 5,592,442 | A | 1/1997 | Nishikawa et al. |
| 5,766,131 | A | 6/1998 | Kondo et al. |
| 6,241,684 | B1 | 6/2001 | Amano et al. |
| 6,477,117 | B1 | 11/2002 | Narayanaswami et al. |
| 6,529,754 | B2 | 3/2003 | Kondo |
| 6,619,835 | B2 | 9/2003 | Kita |
| 7,006,408 | B2 | 2/2006 | Chen |
| 7,123,549 | B2 | 10/2006 | Robert et al. |

(Continued)

OTHER PUBLICATIONS

Newman, Can an Attractive Dumb Watch Be Upgraded into a Smart Watch? http://www.slate.com/..lian_watch_bands_include_a_bluetooth_transmitter_to_add_smart_features.html, dated on May 13, 2014, 14 pages.

(Continued)

*Primary Examiner* — Vit W Miska
(74) *Attorney, Agent, or Firm* — Fish & Richardson P.C.

(57) ABSTRACT

In a general aspect, an ornamental jewelry piece, such as a watch, a ring or a bracelet, includes a sensor package. In some aspects, a timepiece includes a timepiece body having an interior surface that defines a cavity. The timepiece includes a sensor package and a movement in the cavity. The sensor package includes a sensor that monitors the user and a battery that powers the sensor. The movement operates independent of the battery in the sensor package. In some instances, the sensor package tracks fitness data based on motion detected by the sensor and generates an output to the user based on the fitness data.

28 Claims, 7 Drawing Sheets

(56) References Cited

U.S. PATENT DOCUMENTS

| | | | | |
|---|---|---|---|---|
| 8,543,351 | B2 | 9/2013 | Yuen et al. | |
| 8,620,617 | B2 | 12/2013 | Yuen et al. | |
| 8,787,120 | B2 * | 7/2014 | Fleury | G04B 19/12 368/205 |
| 8,886,297 | B2 | 11/2014 | Prstojevich et al. | |
| 2001/0004397 | A1 | 6/2001 | Kita et al. | |
| 2001/0014055 | A1 * | 8/2001 | Martin | G04B 37/0016 368/13 |
| 2002/0151775 | A1 | 10/2002 | Kondo | |
| 2003/0210149 | A1 | 11/2003 | Reisman et al. | |
| 2004/0022130 | A1 | 2/2004 | Chung | |
| 2004/0151071 | A1 | 8/2004 | Kocher | |
| 2004/0237319 | A1 * | 12/2004 | Stotz | G01C 17/38 33/356 |
| 2004/0240323 | A1 * | 12/2004 | Burkhardt | G04G 9/0064 368/88 |
| 2007/0008823 | A1 * | 1/2007 | Plancon | G04C 3/008 368/28 |
| 2007/0191718 | A1 | 8/2007 | Nakamura | |
| 2008/0019219 | A1 * | 1/2008 | Robin | G04C 3/008 368/88 |
| 2008/0027675 | A1 | 1/2008 | Noguchi et al. | |
| 2010/0220559 | A1 * | 9/2010 | Galie | G04C 3/008 368/220 |
| 2011/0003665 | A1 | 1/2011 | Burton et al. | |
| 2011/0032105 | A1 | 2/2011 | Hoffman et al. | |
| 2011/0176395 | A1 * | 7/2011 | Mooring | G04B 37/005 368/276 |
| 2012/0087216 | A1 * | 4/2012 | Keung | A44C 5/0084 368/282 |
| 2012/0213040 | A1 * | 8/2012 | Nakagawa | G04G 9/0005 368/67 |
| 2014/0039804 | A1 | 2/2014 | Park et al. | |

OTHER PUBLICATIONS

Andrew Liszewski, The Bluetooth Buckle Adds Smart Functionality to Mechanical Watches, http:/gizmodo.in/.. .This-bluetooth-Buckes-Adds-Smart-Functionality-To-Mechanical-Watches/articleshow/35078949.cms, retrieved on May 19, 2014, 6 pages.

Ariel Adams, Introducing the Modillian Bluetooth Smart Watch Strap Buckle, A Blog to Watch; http://www.ablogtowatch.com/introducing-modillian-bluetooth-smart-watch-strap-buckle, dated May 13, 2014, 10 pages.

Kuang, How WIRED Designed the Ultimate Smartwatch; http://www.wired.com/2014/01/how-we-designed-the-smart-watch-of-our-dreams/, dated Jan. 7, 2014, 8 pages.

Fitbit Bracelet Silvertone by ActiveElegance on Etsy; http://www.etsy.com/listing/179552105/fitbit-bracelet-silver-tone?utm_s . . . ; retrieved on May 6, 2014, 3 pages.

Iking, Announcing the Tory Burch for Fitbit accessory collection; http://blog.fitbit.com/announcing-the-tory-burch-for-fitbit-accessory-coll . . . , dated Feb. 4, 2014, 12 pages.

* cited by examiner

SENSOR-ENABLED FASHION TIMEPIECE

CROSS-REFERENCE TO RELATED APPLICATIONS

This application is a divisional of and claims the benefit of priority to U.S. patent application Ser. No. 14/476,415, filed Sep. 3, 2014, the contents of which is hereby incorporated by reference.

BACKGROUND

The following description relates to sensor packages for ornamental jewelry, including fashion timepieces and other accessories.

Fashion wristwatches typically have a metal case and bezel, a fashionable watchband, and an ornamental face that displays time. The bezel, face, and other components may include precious metals, gemstones, fashion branding, or other ornamental features. Since many fashion wristwatches are designed to be lightweight and thin, the internal components of the wristwatch (e.g. the movement) are typically designed for compact, space-efficient arrangement inside the case.

SUMMARY

In a general aspect, an ornamental piece of jewelry includes a sensor package. For example, the ornamental piece of jewelry can be a timepiece, a bracelet, a locket, a charm, a ring, a necklace, a brooch, an earring, a pendant, or another type of jewelry.

In some aspects, a wearable timepiece (e.g., a fashion wristwatch) includes a timepiece body having an interior surface that defines a cavity. The timepiece includes a sensor package and a movement in the cavity. The sensor package includes a sensor that monitors the user and a battery that powers the sensor. The movement operates independent of the battery in the sensor package. The sensor can be, for example, a motion sensor that monitors motion of the user, a heart rate sensor that monitors the heart rate of the user, a blood pressure sensor that monitors the blood pressure of the user, or another type of sensor.

In some aspects, a wearable timepiece (e.g., a fashion wristwatch) is retro-fitted to include a sensor-enabled case back. Multiple substantially identical timepiece bodies each include an interior surface that defines a cavity, and a movement in the cavity of each timepiece body operates independent of a case back. Sensor-enabled case backs are applied to a first set of the timepiece bodies. Shell case backs are applied to a second set of the timepiece bodies. The shell case back has a lower profile than the sensor-enabled case back. Each sensor-enabled case back includes a sensor package. The sensor package includes a motion sensor that monitors motion of the timepiece user and a battery that powers the motion sensor.

The details of one or more implementations are set forth in the accompanying drawings and the description below. Other features, objects, and advantages will be apparent from the description and drawings, and from the claims.

DETAILED DESCRIPTION

Figure 1A:
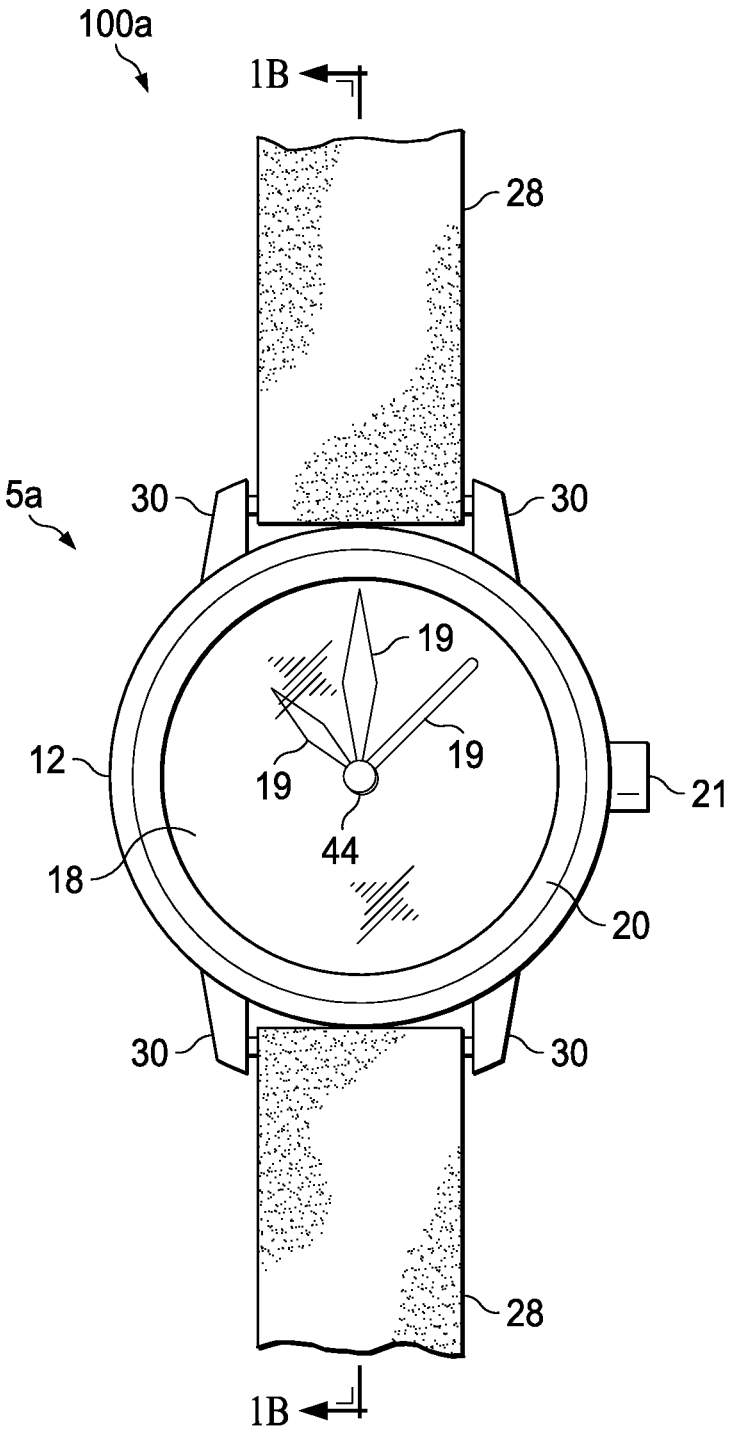
FIG. 1A is a front view of an example timepiece.

In some aspects of what is described here, a watch or another type of ornamental jewelry is equipped with "smart" technology that enables "smart" lifestyle features in an everyday fashion accessory. For example, a fashion-statement watch or another type of fashion accessory can be outfitted with a sensor-enabled component that does not affect the aesthetically-pleasing, ornamental appearance of the fashion accessory. Such fashion accessories may appeal to the connected-fashion consumer lifestyle, by allowing a user to access "smart" lifestyle features in a fashion accessory, as opposed to a fitness or sporting accessory.

In some cases, a fashion accessory includes a sensor package that tracks health and fitness data and wirelessly communicates with an external device. For example, the health and fitness data can be uploaded to the Internet, another fashion accessory, a smartphone, a personal computer, a tablet or another device, and a smartphone app or other software can store, analyze and process the health and fitness data for the user.

Some existing fashion accessories can be retro-fitted with a sensor-enabled component that does not affect the ornamental appearance of the fashion accessory. For example, some existing watches that have conventional case backs can be provided with a sensor-enabled case back that includes an embedded sensor package. To accommodate the sensor package, the sensor-enabled case back may have a slightly higher profile than the original case back. By using small sensors and integrated electronic components, the sensor-enabled case back can be made small enough to preserve the original aesthetic appearance of the watch. For example, the sensor package can have a round or rectangular housing that is 30 mm or smaller in its largest dimension (e.g. diameter or diagonal), and 5 mm or smaller in its smallest dimension (e.g. height). Within the housing, the sensors and other electronic components can be mounted (and interconnected) on a chip or printed circuit board (PCB) component.

In some cases, a sensor-enabled case back affixed to a wristwatch operates independent of the wristwatch itself. For example, the sensor package embedded in the sensor-enabled case back can include a battery that powers the sensors and other electronic components in the sensor package, and the watch can include a movement that independently powers the watch's timekeeping functions. The movement of the watch can be a mechanical movement that does not include a battery, or an electronic movement that includes a separate battery (i.e., separate from the battery in the sensor package). In such cases, the sensor-enabled functionality does not interfere with powering the wristwatch's movement. And the sensor-enabled functionality can be configured independent of the movement, for example, to balance power between the sensor-enabled components and the movement. In other cases, the movement and the sensor package operate on the same battery.

In some implementations, the sensor package for a fashion accessory includes wireless personal area network technology that enables the sensor package to communicate with other "smart" technologies. For example, the sensor package can include a Bluetooth Smart or Bluetooth Low Energy (BLE) integrated circuit or another type of wireless communication component. In some implementations, the sensor package includes output components that generate an alert or another output to the user. For example, the sensor package can include a light-emitting device (e.g. a light emitting diode (LED), etc.), a vibration motor, or another type of output component. In some implementations the sensor package includes a rechargeable battery. For example, an inductive or conductive battery-charge interface can be used to charge the sensor package battery using an external charger.

Figure 1B:
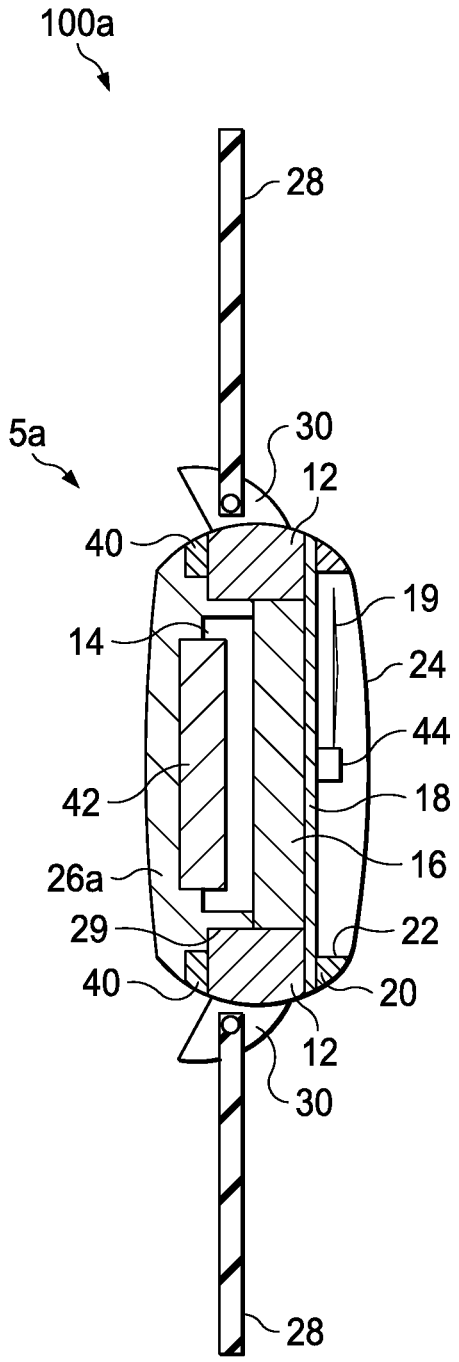
FIG. 1B is a cross-sectional view of the example timepiece of FIG. 1A, including a sensor-enabled case back.

FIG. 1A is a front view of an example timepiece 100*a* that includes a sensor-enabled case back 26*a* (shown in FIG. 1B). The example timepiece 100*a* is a wristwatch that includes a watchband 28 that fastens a timepiece body 5*a* to a user. The sensor-enabled case back 26*a* can be included in other types of timepieces or other types of timepiece bodies (e.g. a pocket watch). FIG. 1B is a cross-sectional view of the example timepiece 100*a* of FIG. 1A.

The example timepiece body 5*a* shown in FIGS. 1A and 1B includes a case 12. The case 12 has an interior sidewall that defines a cavity 14 therein. The cavity 14 receives a movement 16 of the timepiece 100*a*, as well as a face 18 and two or more hands 19 (three shown), therein. The face 18 resides adjacent the movement 16. A crown shaft (not shown) extends outward from the side of the movement 16 through a sidewall of the case 12 and is coupled to a crown 21.

The case 12 may include a removable bezel 20 or the bezel 20 can be integrally formed with the case 12. The bezel 20 defines an aperture 22 through which the face 18 of the timepiece 100*a* can be seen by a user. The bezel 20 carries a transparent cover 24 that covers the aperture 22. The aperture 22 is depicted as being circular, but could be other shapes, for example, square, octagonal, oval, irregular shaped, or otherwise. The transparent cover 24 is shaped appropriately to cover the aperture 22.

The time display on the face 18 of the timepiece 100*a* indicates time in hours, minutes, and seconds; in some timepieces, only hours or minutes are displayed. When viewed through the aperture 22, the time display on the face 18 occupies the majority (in some cases, substantially all) of the face 18. For example, at least one of the hands 19 extends substantially to a perimeter of the face 18. The face 18 may also include additional components that display, for example, the date, the day of the week, the lunar phase, a chronograph, or other information. In some cases, a timepiece body includes a digital time display that occupies the majority (in some cases, substantially all) of the face of the timepiece. A digital time display typically indicates time in hours and minutes, and in some cases, seconds or subsecond units.

The watchband 28 (shown in two portions) is affixed to the ends of the case 12 between outwardly extending lugs 30 arranged in pairs on opposing sides of the case 12. The watchband 28 can be differently configured or attached to the timepiece body 5*a* in another manner. For example, if the timepiece 100*a* were configured as a pocket watch, the watchband 28 can be replaced by a strap, chain, or other type of fob, and the lugs 30 can be replaced by a stem (e.g., with a loop or an eyelet to receive the fob) extending from the case 12.

Figure 1C:
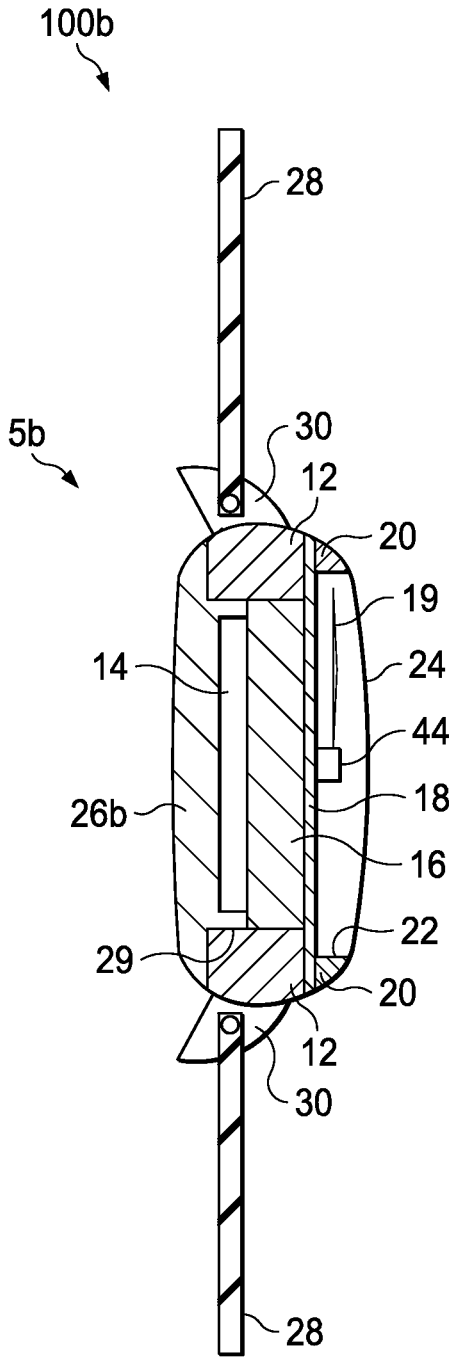
FIG. 1C is a cross-sectional view of an example timepiece that has a shell case back.

As shown in FIG. 1B, the timepiece 100*a* includes a movement 16 that is coupled to the hands 19 by a shaft 44. The movement 16 provides the time-keeping functionality of the timepiece 100*a*, and operates independent of the case back. In other words, the movement 16 operates the same regardless of whether the timepiece body includes a sensor-enabled case back 26*a* (as shown in FIG. 1B), a shell case back 26*b* (as shown in FIG. 1C), or another type of case back. Generally, the movement of a timepiece generates an output for displaying time on the face of the timepiece. In the example shown, the movement 16 generates a mechanical output by turning the shaft 44, which orients the hands 19 to indicate time in the aperture 22. In a digital watch, the movement generates an electrical output (e.g., a voltage signal) that modifies a digital time-display on the face of the watch.

The movement 16 can be an electronic type that is powered by a watch battery, which may be included in or coupled to the movement 16. For example, the movement 16 can be a quartz movement or another type of battery-powered movement. Alternatively, the movement 16 can be a mechanical type that is powered by a mainspring. For example, the mainspring can be wound by a winding post that is wound automatically (e.g., by inertial forces from the timepiece 100*a* being moved, by gravitational forces acting on a winding rotor, etc.) or by a user (e.g., by a user turning a winding stem that protrudes from the case 12).

In the example shown, the movement 16 is substantially circular, and is mounted to the back surface of the face 18. The example movement 16 is as large as the timepiece's case 12 will allow, for example, extending substantially to the inner sidewalls of the case 12 and filling substantially all available space in the cavity 14. In some instances, the movement 16 is smaller than the cavity 14 and accommodates other features or components within the cavity 14.

The sensor-enabled case back 26*a* is affixed to the back of the timepiece body 5*a*. In the example shown, the sensor-enabled case back 26*a* includes a threaded surface 29 that mates with a threaded surface of the case 12. The sensor-enabled case back 26*a* can be applied to the timepiece body 5*a* by screwing the threaded surface 29 against the threaded portion of the inner sidewall of the case 12. The sensor-enabled case back 26*a* can be affixed to the back of the timepiece body in another manner, for example, based on another configuration of the timepiece body. In some cases, the sensor-enabled case back 26*a* includes another type of fastener or additional features such as, for example, seals, apertures, etc.

The sensor-enabled case back 26*a* includes a sensor package 42 and a light-emitting device 40. The sensor package 42 is carried in a recess defined in the sensor-enabled case back 26*a*, and the light-emitting device 40 is carried on the outer perimeter of the sensor-enabled case back 26*a*. The sensor package 42 is connected to the light-emitting device 40 by a conductor (not shown). The sensor package 42 controls (e.g., turns on or off) light emitted from the light-emitting device 40, for example, by voltage-based or current-based electrical signals carried by the conductor. A sensor-enabled case back may include additional or different features, and the components of a sensor-enabled case back can be arranged as shown in FIG. 1B or in another manner.

The sensor package 42 can be circular, rectangular, or another shape. The sensor package 42 can be the example sensor package 300 shown in FIG. 3, or another type of sensor package can be used. As such, the sensor package 42 can include some or all of the example features shown in FIG. 3, or the sensor package can include other features. In some examples, the sensor package 42 includes a motion sensor that monitors motion of the wristwatch user (i.e., the person wearing the timepiece 100*a*), a memory that stores motion data provided by the motion sensor and possibly other information, and a communication device that can transmit information to an external receiver (e.g., a smartphone, a tablet, or another type of device). The motion sensor can include, for example, an accelerometer that detects motion based on acceleratory movement of the timepiece body 5*a*; a gyroscope that detects motion based on an orientation of the timepiece body 5*a*; an altitude sensor that detects motion based on an altitude of the timepiece body 5*a*; a Global Positioning System (GPS) sensor that detects motion based on position coordinates; or a combination of these and other types of sensors.

In some examples, the sensor package 42 includes logic (e.g., a controller, digital circuitry, a microprocessor, etc.) that processes motion data from the motion sensor, and generates output. The logic included in the example sensor package 42 performs fitness- or health-related analysis based on the motion data, and generates the output for the user based on the fitness- or health-related analysis. For example, the logic may track a fitness-metric (e.g., the number of steps taken by the user, the distance traveled by the user, the user's change in altitude, number of calories burned by the user, the user's heart rate, the user's blood pressure, or similar information) over a designated time period (e.g., a predetermined number of hours, a day, a week, a month, etc.); and the processor logic can alert the user when the fitness-metric reaches a predetermined threshold.

The sensor package 42 can provide output to the user through an output device included in the timepiece 100*a* (e.g., the light-emitting device 40, a vibration motor, or another type of output device) or in another manner. In some cases, the timepiece 100*a* can leverage the user's other "smart" devices to provide information to the user. For example, the sensor package 42 may transmit the output (e.g., wirelessly) to the user's smartphone or tablet, which can receive the output from the timepiece 100*a* and provide an alert or another type of output to the user. In some cases, the timepiece 100*a* can leverage a network (e.g., the Internet, a local area network, a personal area network, etc.) or other external devices to upload the output, the sensor data, or other information to a remote device (e.g., a personal computer, a server, etc.).

The components of the timepiece 100*a* shown in FIG. 1A define the ornamental appearance of the example timepiece 100*a*. For a fashion wristwatch, the watchband 28 is typically made of metal, leather, synthetic material (e.g., rubber or other petroleum-based materials) or a combination of them; and the other components typically include ornamental metal (e.g., precious metals, polished steel, etc.), gemstones (e.g., diamond, ruby, sapphire, etc.), embossed surfaces, fashion branding, prominent color or texture styling, or other features that define the overall general appearance of the timepiece 100*a*. Moreover, the timepiece body 5*a* is visually-prominent, and the time-display area on the face 18 is a visually-significant element in the ornamental appearance of the timepiece 100*a*.

As shown, the sensor-enabled case back 26*a* is not visually-prominent when the timepiece 100*a* is worn by the user, and does not significantly affect the ornamental appearance of the timepiece 100*a*. For example, the sensor-enabled case back 26*a* is not visible in the front view shown in FIG. 1A. Although the light-emitting device 40 is not directly visible in a front view of the timepiece 100*a*, light generated by the light-emitting device 40 will typically be visible to the user who is wearing the timepiece 100*a*. For example, the light will illuminate the user's wrist or other background surface. In some cases, instead of (or in addition to) a light-emitting output device, the sensor package 42 includes a tactile output device that provides tactile output to the user. For example, a vibration motor can provide an alert by generating a vibration or vibration pattern. In other examples, a timepiece with a sensor-enabled case back can include other visual output components. For example, the sensor package may provide output to the user through a light-emitting device that is visible on the face of the watch or otherwise illuminates the face of the watch.

FIG. 1C is a cross-sectional view of an example timepiece 100*b* that has a shell case back 26*b*. The example timepiece 100*b* shown in FIG. 1C is similar to the example timepiece 100*a* shown in FIG. 1B, except that the example timepiece 100*b* includes a shell case back 26*b* instead of the sensor-enabled case back 26*a*. The shell case back 26*b* can be a conventional case back. The example shell case back 26*b*, which does not include a sensor package or any other electronic components, is implemented as a thin covering on the back of example timepiece 100*b*.

In the examples shown, the shell case back 26*b* has a lower profile than the sensor-enabled case back 26*a*. In other words, the sensor-enabled case back 26*a* is larger in its height dimension (i.e., the dimension that is perpendicular to the face 18) than the shell case back 26*b*. In its other dimensions (i.e., dimensions that are parallel to the face 18), the sensor-enabled case back 26*a* is the same (e.g. identical or substantially equal to) the shell case back 26*b*. To accommodate the sensor package 42 and the light-emitting device 40, the sensor-enabled case back 26*a* protrudes from the back of the timepiece body 5*a* to a greater extent than the shell case back 26*b* protrudes from the back of the timepiece body 5*b*. Consequently, the height of the example timepiece body 5*a* is greater than the height of the example timepiece body 5*b*.

A sensor-enabled case back can have a profile that is different from the profile of the example sensor-enabled case back 26*a* shown in FIG. 1B. For example, depending on the features included in the sensor-enabled case back, the size and shape of the cavity 14, the arrangement of other components in the cavity 14 and possibly other factors, the profile of a sensor-enabled case back may be larger or smaller. In some instances, a sensor-enabled case back may have the same profile as a shell-type case back, or the sensor-enabled case back may not have a noticeable or substantial effect on the form factor of the timepiece.

The shell case back 26*b* is affixed to the back of the timepiece body 5*b*. Like the sensor-enabled case back 26*a* shown in FIG. 1B, the shell case back 26*b* shown in FIG. 1C includes a threaded surface 29 that mates with a threaded surface of the case 12, and shell case back 26*b* can be applied to the timepiece body 5*b* by screwing the threaded surface 29 against the inner sidewall of the case 12. The shell case back 26*b* can be affixed to the back of the timepiece body in another manner, for example, based on the configuration of the timepiece body. In some cases, the shell case back 26*b* includes another type of fastener or additional features such as, for example, seals, apertures, etc.

Both of the case backs shown (the shell case back 26*b* and the sensor-enabled case back 26*a*) can be removed from the respective timepiece body temporarily, for example, to replace the battery that powers the movement 16, to repair or clean the movement 16 or other features inside the cavity 14, to interchange the case back with another case back, or for another purpose. Moreover, a sensor-enabled case back can be designed to be structurally interchangeable with conventional shell-type case backs. As such, the shell case back 26*b* can be removed permanently and replaced by another case back such as, for example, the sensor-enabled case back 26*a*.

In some cases, a timepiece manufacturer receives many substantially identical timepiece bodies (e.g., all having the same case, bezel, face, and other ornamental features) and selects distinct case backs for distinct subsets of the timepiece bodies. In some examples, a sensor-enabled case back is applied to a first subset of the timepiece bodies, and a shell-type case back is applied to another subset of the timepiece bodies. As a result, all the manufactured timepieces have the same general ornamental appearance and time-keeping functionality, but only the subset receiving the sensor-enabled case backs have the "smart" features provided by the sensor package. In some instances, the sensor-enabled case backs have a slightly higher profile, which increases the height of the "smart" timepieces without substantially affecting the ornamental appearance of the timepieces.

Figure 2A:
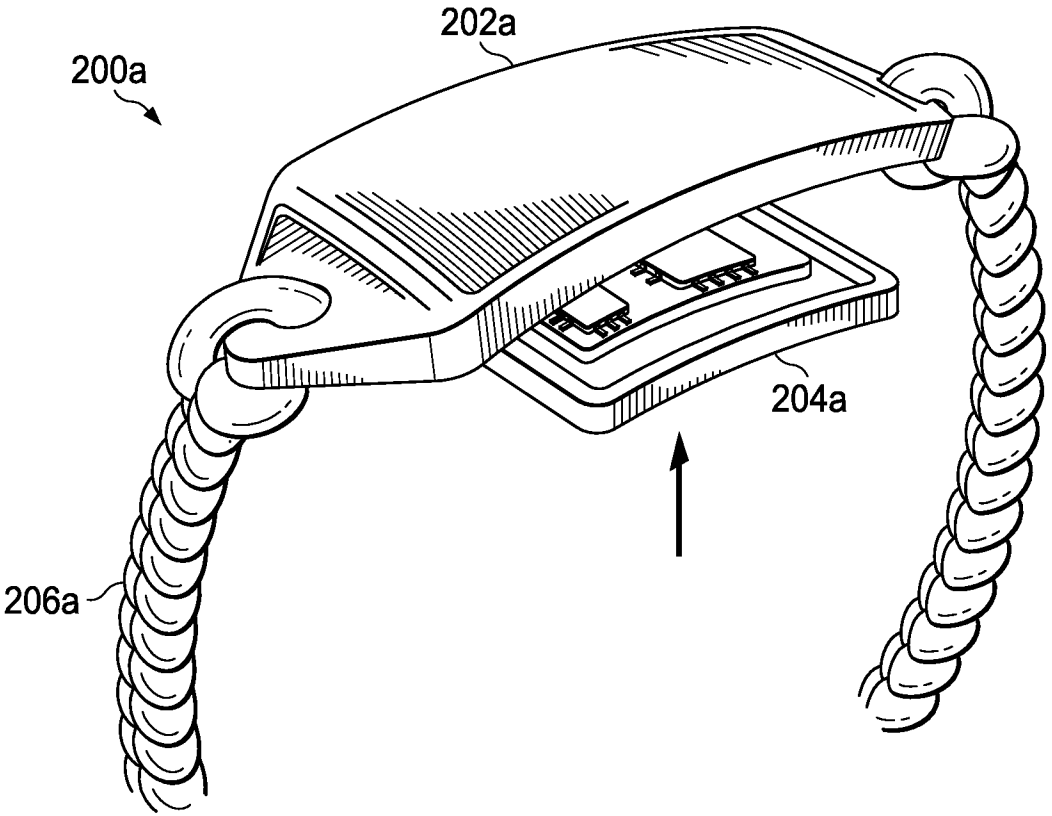
FIG. 2A is a rendering of an example sensor-enabled bracelet.

FIG. 2A is a rendering of an example sensor-enabled bracelet 200*a*. The example sensor-enabled bracelet 200*a* includes an ornamental plate 202*a*, a band 206*a*, and a sensor package 204*a*. A sensor-enabled bracelet may include additional or different components, and the features of a sensor-enabled bracelet can be arranged as shown or in another manner. In some cases, a sensor-enabled bracelet includes a clasp or another type of fastener that secures the bracelet to a user (e.g., to a user's wrist).

The ornamental plate 202*a* and the band 206*a* can be made of metal (e.g., precious metal, polished metal, etc.), leather, or another material. The plate 202*a* can be embossed with words, designs, or branding, adorned with jewels or studs, or styled in another manner. In the example shown, the ornamental plate 202*a* and the band 206*a* define the ornamental appearance of the sensor-enabled bracelet 200*a*. For example, the sensor-enabled bracelet 200*a* can be a fashion accessory that is designed to accommodate a sensor package, or the sensor-enabled bracelet 200*a* can be a fashion accessory that was not designed to accommodate a sensor package but has been retro-fitted with a sensor package.

The sensor package 204*a* can be affixed to a lower surface of the ornamental plate 202*a* or another location. In the example shown, when the sensor-enabled bracelet 200*a* is worn by a user, the sensor package 204*a* is not a visually-prominent feature of the bracelet. For example, in some instances the sensor package 204*a* is not visible when the sensor-enabled bracelet 200*a* is worn in a normal manner. The sensor package 204*a* can be applied to the ornamental plate 202*a*, for example, by adhesive (e.g. glue, epoxy, etc.), by fasteners (e.g., screws), or another manner (e.g., soldering, welding, brazing).

Figure 2B:
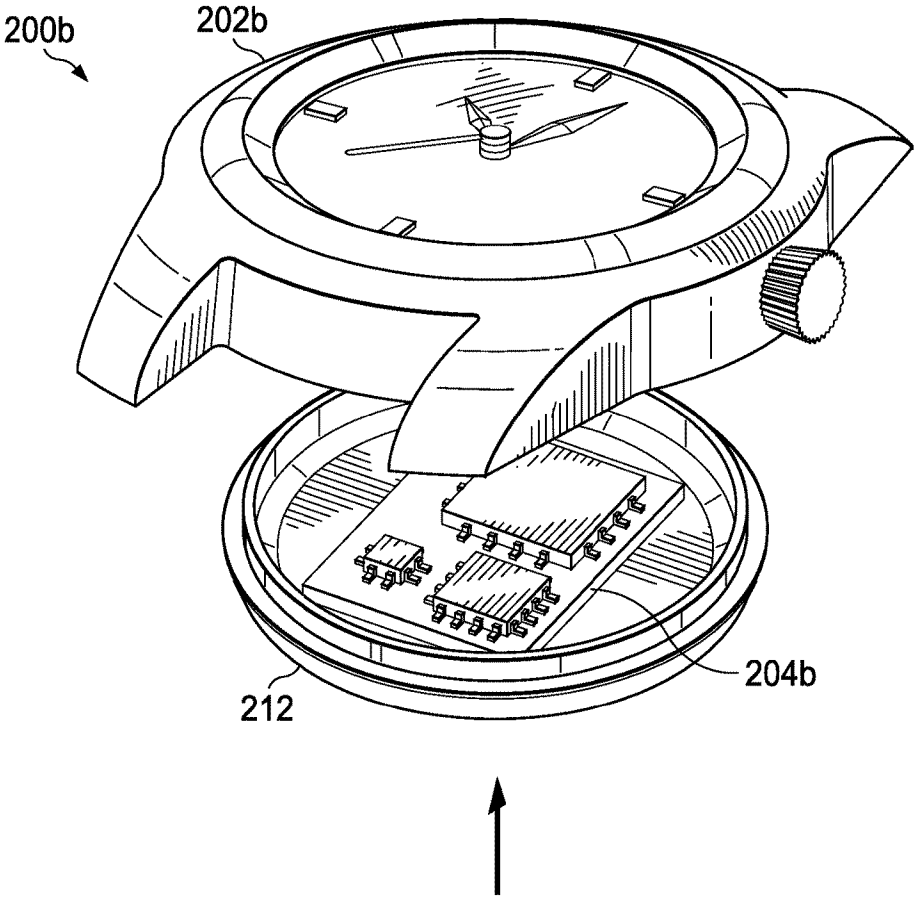
FIG. 2B is a rendering of an example sensor-enabled timepiece.

FIG. 2B is a rendering of an example sensor-enabled timepiece 200*b*. The example sensor-enabled timepiece 200*b* includes timepiece body 202*b*, a case back 212, and a sensor package 204*b*. A sensor-enabled timepiece may include additional or different components, and the features of a sensor-enabled timepiece can be arranged as shown or in another manner. In some cases, a sensor-enabled timepiece includes a band or another type of fastener that secures the timepiece to a user (e.g., to a user's wrist).

The example sensor-enabled timepiece 200*b* can be implemented as a wristwatch (e.g., as the example timepiece 100*a* shown in FIGS. 1A and 1B), as a locket or charm, or in another manner. In the example shown, the timepiece body 202*b* (and, in some cases, a band or fob connected to the timepiece body 202*b*) defines the ornamental appearance of the sensor-enabled timepiece 200*b*. For example, the sensor-enabled timepiece 200*b* can be a fashion accessory that is designed to accommodate a sensor package, or the sensor-enabled timepiece 200*b* can be a fashion accessory that was not designed to accommodate a sensor package but has been retro-fitted with a sensor package. The sensor package 204*b* can be affixed to a lower or upper surface of the case back 212 or in another location on the timepiece. The sensor package 204*b* can be applied to the timepiece or a component of a timepiece, for example, by adhesive (e.g. glue, epoxy, etc.), by fasteners (e.g., screws), or another manner (e.g., soldering, welding, brazing).

Figure 2C:
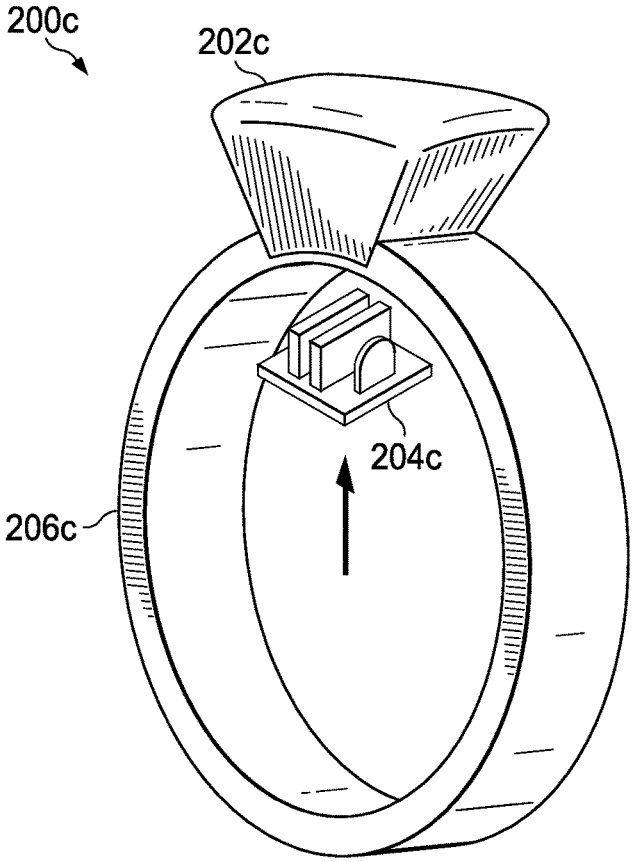
FIG. 2C is a rendering of an example sensor-enabled ring.

FIG. 2C is a rendering of an example sensor-enabled ring 200*c*. The example sensor-enabled ring 200*c* includes a setting 202*c*, a band 206*c*, and a sensor package 204*c*. A sensor-enabled ring may include additional or different components, and the features of a sensor-enabled ring can be arranged as shown or in another manner. The band 206*c* can secure the ring to a user's finger or other location.

The setting 202*c* and the band 206*c* can be made of metal (e.g., precious metal, polished metal, etc.) or another material, and can include gemstones or other ornamental features. The setting 202*c* can include prongs, a bezel, one or more gemstones, etc. The band 206*c* can be embossed with a design, channeled, adorned with jewels or studs, or styled in another manner. In the example shown, the setting 202*c* and the band 206*c* define the ornamental appearance of the sensor-enabled ring 200*c*. For example, the sensor-enabled ring 200*c* can be a fashion accessory that is designed to accommodate a sensor package, or the sensor-enabled ring 200*c* can be a fashion accessory that was not designed to accommodate a sensor package but has been retro-fitted with a sensor package.

The sensor package 204*c* can be affixed to an interior surface of the band 206*c* or another location on the ring. In the example shown, when the sensor-enabled ring 200*c* is worn by a user, the sensor package 204*c* is not a visually-prominent feature of the ring. For example, in some instances the sensor package 204*c* is not visible when the sensor-enabled ring 200*c* is worn in a normal manner. The sensor package 204*c* can be applied to the ring, for example, by adhesive (e.g., glue, epoxy, etc.), by fasteners (e.g., screws), or another manner (e.g., soldering, welding, brazing).

Figure 2D:
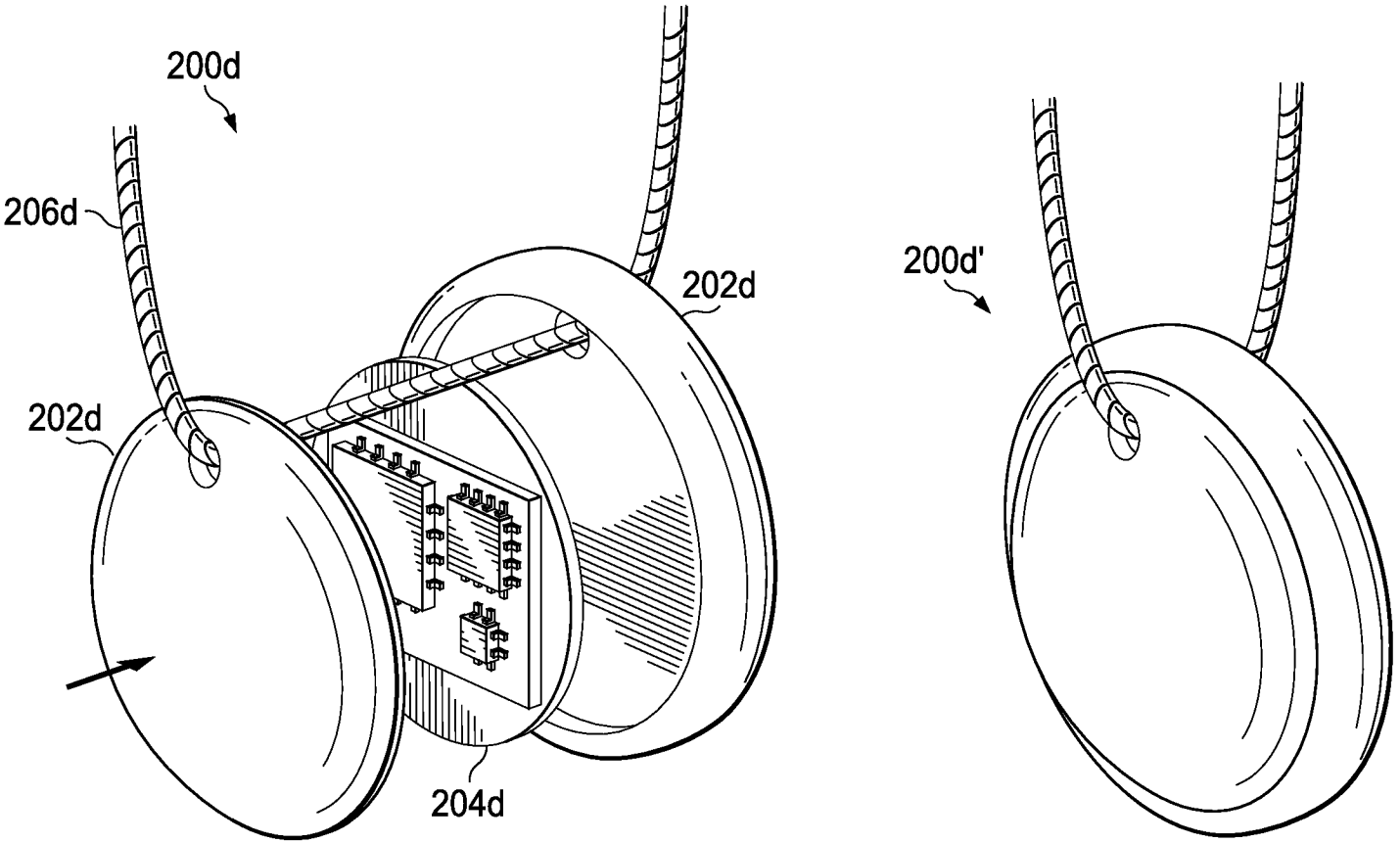
FIG. 2D is a rendering of an example sensor-enabled necklace.

FIG. 2D is a rendering of an example sensor-enabled necklace 200*d*. The example sensor-enabled necklace 200*d* includes a charm 202*d*, a chain 206*d*, and a sensor package 204*d*. The necklace 200*d*' on the right in FIG. 2D shows the two sides of the charm 202*d* closed together, with the sensor package 204*d* enclosed between them. A sensor-enabled necklace may include additional or different components, and the features of a sensor-enabled necklace can be arranged as shown or in another manner. The chain 206*d* can secure the necklace about a user's neck or other location.

The charm 202*d* and the chain 206*d* can be made of metal (e.g., precious metal, polished metal, etc.) or another material, and can include gemstones or other ornamental features. The charm 202*d* and the chain 206*d* can be of any shape or type, and can be styled in number of different ways. In the example shown, charm 202*d* and the chain 206*d* define the ornamental appearance of the sensor-enabled necklace 200*d*.

For example, the sensor-enabled necklace 200*d* can be a fashion accessory that is designed to accommodate a sensor package, or the sensor-enabled necklace 200*d* can be a fashion accessory that was not designed to accommodate a sensor package but has been retro-fitted with a sensor package.

The sensor package 204*d* can be affixed to an interior surface of the charm 202*d* or another location on the necklace. In the example shown, when the sensor-enabled necklace 200*d* is worn by a user, the sensor package 204*d* is not a visually-prominent feature of the necklace (as shown on the right in FIG. 2D). For example, in some instances the sensor package 204*d* is not visible when the sensor-enabled necklace 200*d* is worn in a normal manner. The sensor package 204*d* can be applied to the charm 202*d*, for example, by adhesive (e.g., glue, epoxy, etc.), by fasteners (e.g., screws), or another manner (e.g., soldering, welding, brazing).

Figure 2E:
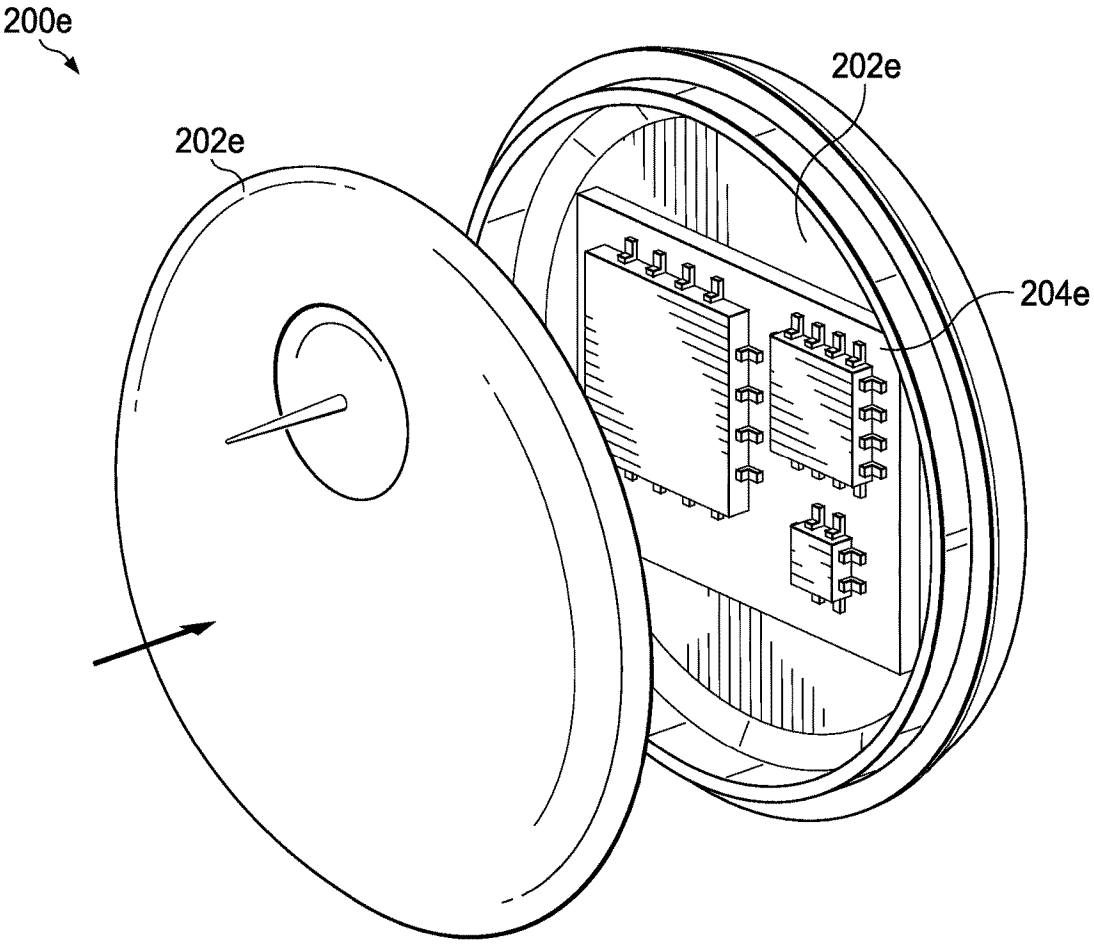
FIG. 2E is a rendering of an example sensor-enabled earring.

FIG. 2E is a rendering of an example sensor-enabled earring 200*e*. The example sensor-enabled earring 200*e* includes a disc 202*e* and a sensor package 204*e*. The earring 200*e* can be a stud earring, a hoop earring, a drop earring, a clip-on earring, or another type of earring. A sensor-enabled earring may include additional or different components, and the features of a sensor-enabled ring can be arranged as shown or in another manner. The disc 202*e* includes a post that can receive an earring back to secure the earring to a user's ear or other location. In some cases, the sensor-enabled earring 200*e* can include a push back, a screw back, a latch back, or another type of earring back.

The disc 202*e* can be made of metal (e.g., precious metal, polished metal, etc.) or another material, and can include gemstones or other ornamental features. The disc 202*e* can be embossed with a design, channeled, adorned with jewels or studs, or styled in another manner. In the example shown, the disc 202*e* defines the ornamental appearance of the sensor-enabled earring 200*e*. For example, the sensor-enabled earring 200*e* can be a fashion accessory that is designed to accommodate a sensor package, or the sensor-enabled earring 200*e* can be a fashion accessory that was not designed to accommodate a sensor package but has been retro-fitted with a sensor package.

The sensor package 204*e* can be affixed to an interior surface of the disc 202*e* or another location on the earring. In the example shown, when the sensor-enabled earring 200*e* is worn by a user, the sensor package 204*e* is not a visually-prominent feature of the earring. For example, in some instances the sensor package 204*e* is not visible when the sensor-enabled earring 200*e* is worn in a normal manner. The sensor package 204*e* can be applied to the earring, for example, by adhesive (e.g., glue, epoxy, etc.), by fasteners (e.g., screws), or another manner (e.g., soldering, welding, brazing).

FIGS. 2A, 2B, 2C, 2D and 2E show examples of sensor packages incorporated into multiple different types of jewelry, each having a distinct form factor. A sensor package can be incorporated into other types of ornamental jewelry, including ornamental jewelry having a form factor that is different from the examples shown.

The example sensor packages 204*a*, 204*b*, and 204*c* can be circular, rectangular, or another shape. They can operate as (and may include some or all of the components of) the example sensor package 300 shown in FIG. 3, the example sensor package 42 shown in FIG. 1B, or another type of sensor package. For example, the sensor packages 204*a*, 204*b*, and 204*c* may include a motion sensor that monitors motion of the user (i.e., the person wearing the jewelry), a memory that stores motion data or other fitness-related information, a communication device that can transmit the motion data or other fitness-related information to an external receiver (e.g., a smartphone, a tablet, or another type of device), an output device that generates alerts or other output to the user, logic (e.g., a controller, digital circuitry, a microprocessor, etc.) that processes motion data from the motion sensor and generates the output, or other components.

Figure 3:
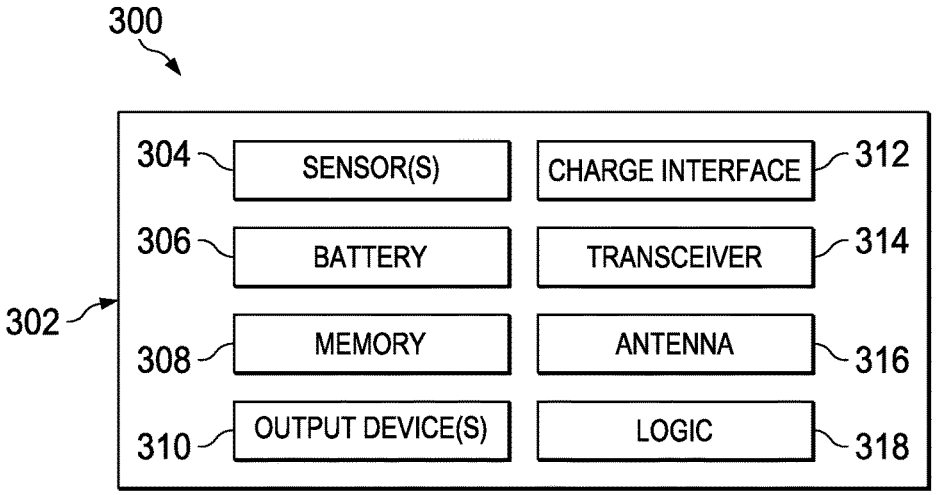
FIG. 3 is a schematic diagram of an example sensor package.

FIG. 3 is a schematic diagram of an example sensor package 300. The example sensor package 300 includes a substrate 302, one or more sensors 304, a battery 306, a memory 308, one or more output devices 310, a charge interface 312, a transceiver 314, an antenna 316, and logic 318. A sensor package may include additional or different features, and the features of the sensor package may operate as described with respect to FIG. 3 or in another manner.

In some implementations, the substrate 302 supports or houses all the other features of the sensor package 300. In some implementations, some of the features are supported apart from the substrate 302, for example, on or within another substrate or housing. The substrate 302 can include connectors (e.g., leads, vias, etc.), a data bus, a power bus, and other features that allow the components of the sensor package 300 to communicate with each other or with external systems.

The sensor package 300 can be included in a fashion accessory (e.g., a wristwatch, bracelet, a locket, a charm, a ring, a necklace, a brooch, an earring, a pendant, etc.), for example, as shown and described above or in another manner. The sensor package 300 or individual components of the sensor package 300 can be directly affixed to the fashion accessory, or the sensor package can be housed in a housing that is affixed to the fashion accessory. For example, the substrate 302 and the components that it supports can be enclosed (e.g. partially or entirely) within a housing or another protective structure that is mounted to a case back for a wristwatch, to a ring band, or another jewelry component.

The example sensor(s) 304 can include a motion sensor that detects motion of a user, a heart rate sensor that detects the heart rate of the user, a blood pressure sensor that detects the blood pressure of the user, or any combination these or other types of sensors. In some examples, the sensor(s) 304 include an accelerometer that detects motion based on acceleration of the sensor package 300; a gyroscope that detects motion based on an orientation of the sensor package 300; an altitude sensor that detects motion based on an altitude of the sensor package 300; a Global Positioning System (GPS) sensor that detects motion based on position coordinates; or a combination of these and other types of sensors that detect motion based on multiple different sensing modes. In some cases, the sensor(s) 304 include a pedometer or another type of motion sensor that tracks the number of steps or the distance traveled by a user. In some cases, another type of motion sensor is used.

The example battery 306 provides power to the other components of the sensor package 300. For example, the battery can provide a constant (e.g., direct current) voltage on a voltage bus that is connected to one or more other components carried by the substrate 302. For instance, the battery 306 can power the output devices 310, the transceiver 314, the memory 308, or other components. The example battery 306 is conductively connected to the charge interface 312, and can receive electrical power from an external power source through the charge interface 312. The charge interface 312 can be a conductive charge interface that receives electrical power by conductive contact with the external power source; or the charge interface 312 can be an inductive charge interface that receives electrical power by inductive (i.e., non-contact) interaction with the external power source. For example, a standard inductive charging interface can be used in some implementations.

The example memory 308 can store sensor data from the sensors 304, from the logic 318, or from other sources. The memory 308 can include a computer-readable storage medium (e.g., flash memory, a storage device, volatile memory, nonvolatile memory, etc.). The example logic 318 can process the sensor data and possibly other types of information stored in the memory 308. The logic 318 can be implemented as a digital electronic controller or another type of device. For example, the logic 318 may be implemented as an FPGA (field programmable gate array), an ASIC (application specific integrated circuit), a programmable processor, a microcontroller, digital logic circuitry, or another type of subsystem.

Generally, the logic 318 can include one or more digital electronic controllers configured to send information to and receive information from a communication interface, a memory, digital or analog circuitry, or other electronic devices. For example, the logic 318 may interface with the memory 308, the sensors 304, the output devices 310, the transceiver 314, etc. The logic 318 can be configured to track a user's fitness or other health-related information based on sensor data from the sensors 304. The output data generated by the logic 318 can be output to the user (e.g., through the output devices 310), stored (e.g., in the memory 308) or uploaded for analysis (e.g., through the transceiver 314 and antenna 316), or processed in another manner.

In some cases, the logic 318 performs the fitness- or health-related analysis based on comparing the user's activity (determined from the sensor data) against a threshold or another parameter. For example, the logic 318 can track a fitness-metric (e.g., the number of steps taken by the user, the distance traveled by the user, the user's change in altitude, number of calories burned by the user, the user's heart rate, the user's blood pressure, or similar information) over a designated time period (e.g., a predetermined number of hours, days, etc.), and alert the user when the fitness-metric reaches a predetermined threshold. The alert or another type of output can be provided to the user, for example, through a communication device or the output device 310. Additionally or alternatively, the output of the fitness- or health-related analysis can be uploaded to a remote server or personal computing system.

The example transceiver 314 and antenna 316 can operate as a communication device that sends information to or receives information from an external device. In some instances, the transceiver 314 converts a message to a radio-frequency signal, and the antenna 316 transmits the radio-frequency signal wirelessly. In some instances, the antenna 316 receives radio-frequency signals from an external device and transfers them to the transceiver 314. The transceiver 314 can convert the radio-frequency signals to digital information that can be stored in the memory 308, processed by the logic 318, processed by the output devices 310, or handled in another manner. In some implementations, the sensor package 300 can communicate with another sensor package directly or indirectly (i.e., with or without leveraging a smartphone, with or without leveraging the Internet, etc.). For example, the sensor package 300 may communicate with another sensor package directly through their respective BLE interfaces.

The output devices 310 can include visual output devices, tactile output devices, audio output devices, or a combination of these. An example of a visual output device is a light-emitting device that produces light that is visible to a user. In some instances, a light-emitting output device can generate multiple different types of light signals to indicate different types of information to the user. For example, a red light or a green light may indicate different statuses with respect to a fitness-metric. Other types of visual output devices may be used. An example of a tactile output device is a vibration motor that vibrates in a manner that can be felt by a user. In some instances, a vibration motor can generate multiple different modes of vibration to indicate different types of information, such as, for example, status with respect to a fitness-metric. Other types of tactile output devices may be used.

In some implementations, the sensor package 300 can perform a variety of functions and generate output to the user based on a variety of conditions. For example, the sensor package 300 may generate output to the user based on tracking and analyzing physical activity (e.g., steps, calories, distance, heart rate, blood pressure, etc.) with respect to fitness-related metrics; the sensor package 300 may generate output to the user based on information received from another device (e.g., a smart phone, a tablet, etc.); the sensor package 300 may generate output to the user based on the location of the sensor package 300 or proximity to other devices; or the sensor package can be configured to intelligently discover or interact with other sensor-enabled devices (e.g., another sensor-enabled fashion accessory, etc.). In some instances, the sensor package 300 can notify the user of an incoming call on the user's smart phone, emit a specific color of light based on a current location, proximity to another device, status with respect to a fitness-related metric, or another condition.

In some implementations, the sensor package 300 can include a large memory capacity (e.g., multi-gigabyte memory), hardware for multiple modes of wireless communication (e.g., Wi-Fi, Bluetooth, near-field communication (NFC), infrared, cellular, etc.), a microphone, a speaker, gesture-detection capabilities (e.g., gyroscopes, e-compass, etc.), location-detection capabilities (e.g., GPS), biometric sensing capabilities (e.g., heart rate, blood pressure, etc.). As such, the sensor package 300 can be adapted for various applications, use cases, and use environments.

While this specification contains many details, these should not be construed as limitations on the scope of what may be claimed, but rather as descriptions of features specific to particular examples. Certain features that are described in this specification in the context of separate implementations can also be combined. Conversely, various features that are described in the context of a single implementation can also be implemented in multiple embodiments separately or in any suitable subcombination.

A number of embodiments have been described. Nevertheless, it will be understood that various modifications can be made. Accordingly, other embodiments are within the scope of the following claims.

What is claimed is:

1. A method of manufacturing timepieces, the method comprising:

receiving a plurality of substantially identical timepiece bodies, each timepiece body comprising an interior surface that defines a cavity, each timepiece body comprising a movement in the cavity that operates independent of a case back;

applying sensor-enabled case backs to a first set of the timepiece bodies, each sensor-enabled case back comprising a sensor package comprising:
a sensor that monitors a timepiece user; and
a battery that powers the sensor; and
applying shell case backs to a second set of the timepiece bodies, each shell case back, when applied, having no sensor package;
wherein the sensor-enabled case back comprises a light-emitting device positioned on a perimeter of the sensor-enabled case back.

2. The method of claim 1, wherein the sensor package further comprises a processor configured to alert the user when a fitness-metric reaches a predetermined threshold, and the light-emitting device is configured to emit a specific color of light in response to the fitness-metric reaching the predetermined threshold.

3. The method of claim 1, where each sensor-enabled case back is assembled with its sensor package prior to being applied to a respective one of the first set of the timepiece bodies.

4. The method of claim 1, wherein each sensor-enabled case back comprises a body defining a recess and wherein the sensor package is carried in the recess prior to the sensor-enabled case back being applied to a respective one of the first set of the timepiece bodies.

5. The method of claim 1, wherein each timepiece body further comprises:
a face that displays time; and
hands secured to a shaft that extends through the face, the shaft being driven by the movement and controlling an orientation of each respective hand.

6. The method of claim 1, wherein applying the sensor-enabled case back to the first set of the timepiece bodies encloses the sensor package in the cavity of the first set of the timepiece bodies.

7. The method of claim 1, wherein each shell case back has a maximum height that is smaller than the sensor-enabled case backs.

8. The method of claim 1, wherein the sensor package further comprises a processor configured to alert the user when a fitness-metric reaches a predetermined threshold.

9. The method of claim 8, wherein the predetermined threshold comprises the number of steps taken by the user.

10. The method of claim 8, wherein the predetermined threshold comprises the user's change in altitude.

11. The method of claim 8, wherein the predetermined threshold comprises the number of calories burned by the user.

12. The method of claim 8, wherein the processor is configured to alert the user of an incoming communication on a smart phone carried by the user.

13. The method of claim 1, wherein the sensor package further comprises a processor configured to alert the user of an incoming communication on a smart phone carried by the user.

14. The method of claim 1, wherein the sensor comprises an accelerometer, a gyroscope, an altitude sensor, or a Global Positioning System (GPS) sensor.

15. A method comprising:
providing a timepiece body comprising an interior surface that defines a cavity and a movement in the cavity that operates independent of a case back;
providing a shell case back, the shell case back having no sensor package; and
providing a sensor-enabled case back, the sensor-enabled case back comprising a sensor package carried in a body of the sensor-enabled case back and comprising:
a sensor that monitors a timepiece user; and
a battery that powers the sensor;
where sensor-enabled case back comprises a body defining a recess and where the sensor is carried in the recess prior to being applied to the timepiece body; and
wherein the sensor-enabled case back comprises a light-emitting device positioned on a perimeter of the sensor-enabled case back.

16. The method of claim 15, wherein each shell case back has a maximum height that is smaller than the sensor-enabled case back.

17. The method of claim 15, wherein the sensor package further comprises a processor configured to alert the user when a fitness-metric reaches a predetermined threshold.

18. The method of claim 17, wherein the predetermined threshold comprises the number of steps taken by the user.

19. The method of claim 17, wherein the predetermined threshold comprises the user's change in altitude.

20. The method of claim 17, wherein the predetermined threshold comprises the number of calories burned by the user.

21. The method of claim 17, wherein the processor is configured to notify the user of an incoming communication on a smart phone carried by the user.

22. The method of claim 15, wherein the sensor package further comprises a processor configured to alert the user of an incoming communication on a smart phone carried by the user.

23. The method of claim 15, wherein the sensor comprises an accelerometer, a gyroscope, an altitude sensor, or a Global Positioning System (GPS) sensor.

24. The method of claim 15, wherein the sensor-enabled case back is provided after providing the shell back case.

25. The method of claim 15, wherein the shell case back is provided assembled to the timepiece body.

26. A method of manufacturing timepieces, the method comprising:
receiving a plurality of substantially identical timepiece bodies, each timepiece body comprising an interior surface that defines a cavity, each timepiece body comprising a movement in the cavity that operates independent of a case back;
applying sensor-enabled case backs to a first set of the timepiece bodies, each sensor-enabled case back comprising a sensor package comprising:
a sensor that monitors a timepiece user;
a battery that powers the sensor; and
a processor configured to alert the user when a fitness-metric reaches a predetermined threshold, and configured to alert the user of an incoming communication on a smart phone carried by the user; and
applying shell case backs to a second set of the timepiece bodies, each shell case back, when applied, having no sensor package;
wherein each shell case back has a maximum height that is smaller than the sensor-enabled case backs; and
wherein the sensor-enabled case back comprises a light-emitting device positioned on a perimeter of the sensor-enabled case back.

27. The method of claim 26, wherein the light-emitting device positioned on a perimeter of the sensor-enabled case back is configured to emit a light when the fitness-metric reaches the predetermined threshold.

28. The method of claim 27, wherein each sensor-enabled case back comprises a body defining a recess and wherein the sensor package is carried in the recess prior to the sensor-enabled case back being applied to a respective one of the first set of the timepiece bodies.

* * * * *